US006820378B2

(12) United States Patent
Lehto

(10) Patent No.: US 6,820,378 B2
(45) Date of Patent: Nov. 23, 2004

(54) SYSTEM AND METHOD SPECIFICALLY INTENDED FOR THE CONSTRUCTION OF FUEL DISTRIBUTION FORECOURTS

(76) Inventor: Pekka Lehto, Alatie 22, Espoo FIN-02360 (FI)

( * ) Notice: Subject to any disclaimer, the term of this patent is extended or adjusted under 35 U.S.C. 154(b) by 0 days.

(21) Appl. No.: 10/009,320

(22) PCT Filed: Mar. 1, 2001

(86) PCT No.: PCT/FI01/00206

§ 371 (c)(1),
(2), (4) Date: Nov. 13, 2001

(87) PCT Pub. No.: WO01/69012

PCT Pub. Date: Sep. 20, 2001

(65) Prior Publication Data

US 2003/0100988 A1 May 29, 2003

(30) Foreign Application Priority Data

Mar. 15, 2000 (FI) ..... 20000598

(51) Int. Cl.[7] ..... E04B 1/343; E04H 5/00

(52) U.S. Cl. ..... 52/126.5; 52/169.9; 52/296; 52/741.15

(58) Field of Search ..... 52/126.5, 126.6, 52/169.3, 169.4, 169.9, 292, 294, 295, 296, 297; 137/234.6

(56) References Cited

U.S. PATENT DOCUMENTS

| | | | | |
|---|---|---|---|---|
| 2,021,544 A | | 11/1935 | Crown | |
| 2,959,826 A | | 11/1960 | Larsen et al. | |
| 3,858,371 A | * | 1/1975 | Averill | 52/66 |
| 4,332,116 A | * | 6/1982 | Buchanan | 52/82 |
| 4,901,748 A | * | 2/1990 | Shotmeyer | 137/234.6 |
| 4,930,270 A | * | 6/1990 | Bevacqua | 52/126.1 |
| 4,986,446 A | | 1/1991 | Montgomery et al. | |
| 6,105,602 A | * | 8/2000 | Sistonen | 137/234.6 |

FOREIGN PATENT DOCUMENTS

| | | |
|---|---|---|
| EP | 0580235 A1 | 1/1994 |
| FI | 94889 B | 6/1995 |
| NL | 8501388 A | 12/1985 |

* cited by examiner

*Primary Examiner*—Michael Safavi
(74) *Attorney, Agent, or Firm*—Skinner & Associates

(57) ABSTRACT

A system and method specifically intended for the construction of fuel distribution forecourts, in which the forecourt contains at least one distribution pump (17), possibly an attached automatic dispenser (9), a pillar (4), which is specifically installed onto a concrete footing, to support the roof and necessary electrical and pipework systems for the drawing of fuel from the fuel storage tank and dispensing to motor vehicles and equivalents. The pumps (17), automatic dispenser (9) and other necessary ground-based equipment are installed on the island (6, 7), which is in turn supported (11, 12) on the roof's concrete footing.

8 Claims, 5 Drawing Sheets

SYSTEM AND METHOD SPECIFICALLY INTENDED FOR THE CONSTRUCTION OF FUEL DISTRIBUTION FORECOURTS

This invention relates to a system and method specifically intended for the construction of fuel distribution forecourts. Specifically, this applies in particular to a forecourt from which fuel is distributed to motor vehicles.

Traditionally forecourts have been constructed in such a way that the islands are cast in situ or a modular base assembled for the forecourt sheltering roof structures. After this, filing work is performed, the roof's pillars are erected and installation wells set into the sealed foundations. Subsequently the modular construction island is assembled or the island is cast above the installation well. After the installation of the island the distribution devices are installed: pumps, automatic dispensers and other devices.

This technique is a slow, multi-stage method, because it includes several consecutive work phases which mostly depend at least upon the previous phase. Installations to the installation wells can only be made after all of the forecourt structures have been sealed.

The problem with this technique is that, in addition to the large amount of work and prolonged work stages, the possibility of subsidence of the forecourts constructed layer, which causes subsidence of the island and installation wells, along with all of the ground-based structures and could, at worst, result in damage to the pipe system.

There is also a system in use with the prior art, in which the load of the forecourt roof pillar is taken onto the fuel storage tank and, via a reinforced concrete structure which runs along the length of the sides of the reservoir, right down to the ground. In this system, the fuelpipe system is mostly located within a service-shaft constructed above the reservoir and the island is fitted over this.

When constructing according to the state of the art described above, the roofs foundations and the main service shaft arm installed at the time of installation of the storage tank. The excavation for the storage tank requires extensive and deep excavation-work concomitantly with the erection of the roof. Also, when using the prior art, the forecourts protective membrane cannot be fitted beneath the island because it is fixed over the storage tank.

Another problem with the prior art is also that there is no possibility of installing distribution equipment in an economical way; pumps, automatic dispensers etc. can only be fitted to the island after the forecourt surfaces have been completed.

In addition, repair work and alterations are labour-intensive and difficult to accomplish in petrol stations produced by the prior art, because the mechanism-containing island and storage tank must be removed from use during the repositioning of the equipment. Furthermore, the recycling and re-use of old components is difficult and expensive.

The purpose of this invention is to remove the problems associated with the prior art and create completely new technique for the construction of a load-bearing forecourt, in which the load-bearing structures are effectively utilized to support the non-load-bearing components. An additional purpose is to allow an adjustable structure if desired. According to this invention, it is intended to be able to produce a forecourt, which can be constructed to user-readiness faster than by the prior art.

The above mentioned and other advantages and benefits of this invention are thus achieved as is characteristically stated in the attached claims.

The basis of this invention is that adjustable columns are installed on the footing element of the canopy and the load-bearing island is placed on the adjustable columns at the adjusted and desired height. The columns of the canopy can now be installed on the foundation, as in the prior art. The island contains pre-fitted sumps and fittings necessary for the distribution equipment.

There follows a detailed description of the invention with references to the attached drawings. In which one of the possible applications of the invention is illustrated in simplified figures. It is clear that this invention is not by any means restricted to just the one embodiment but can be adapted in many ways whilst still remaining within the scope of the invention's original idea and patent conditions.

Figure 3:
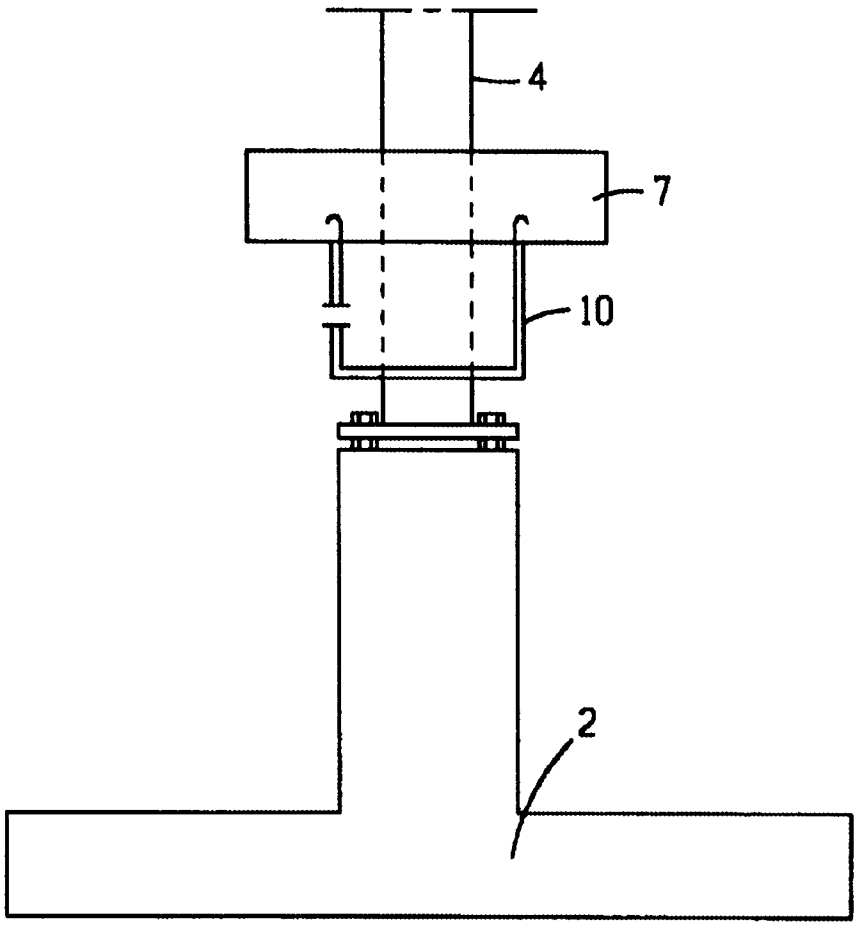
FIG. 3 shows a stripped down version of the same structure, as seen when rotated 90° in the other direction (i.e. in the opposite direction to that in FIG. 2)
Figure 4:
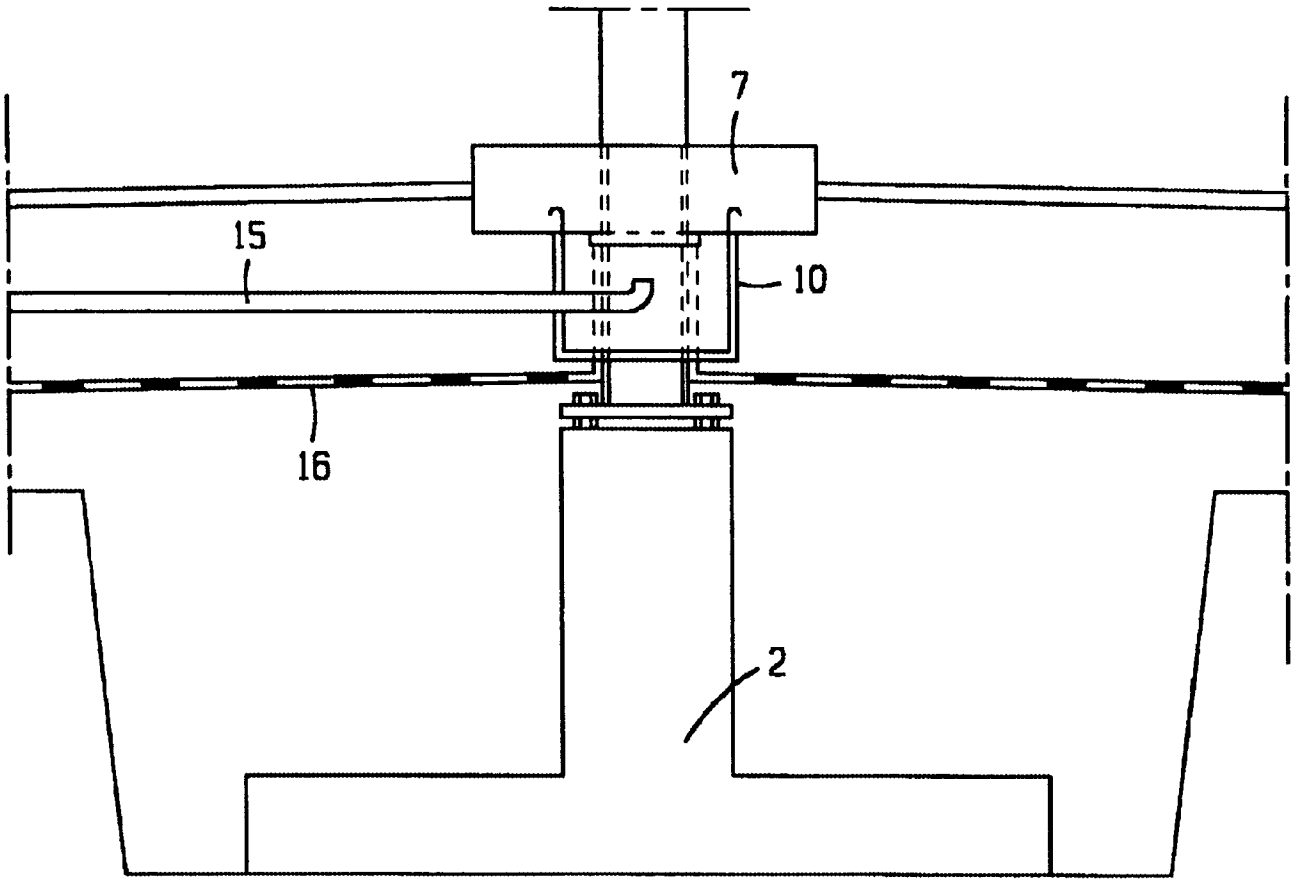
Figure 5:
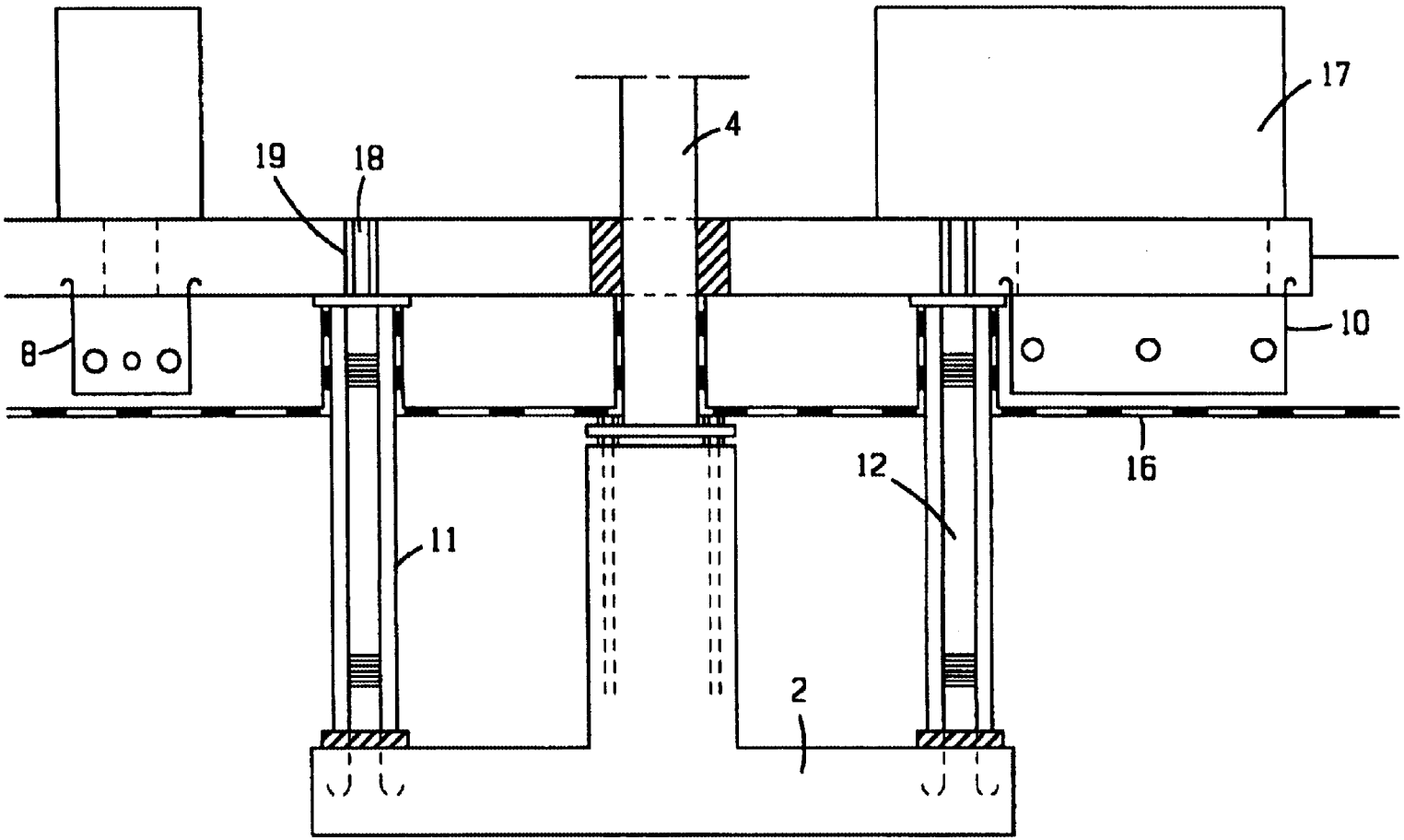

In FIG. 4, the same structure as in FIG. 3 is shown as it appears when it is fitted to the ground and with equipment connected to it; and In FIG. 5, the structure of the environment-protecting membrane is illustrated, according to one permutation of this invention.

Figure 1:
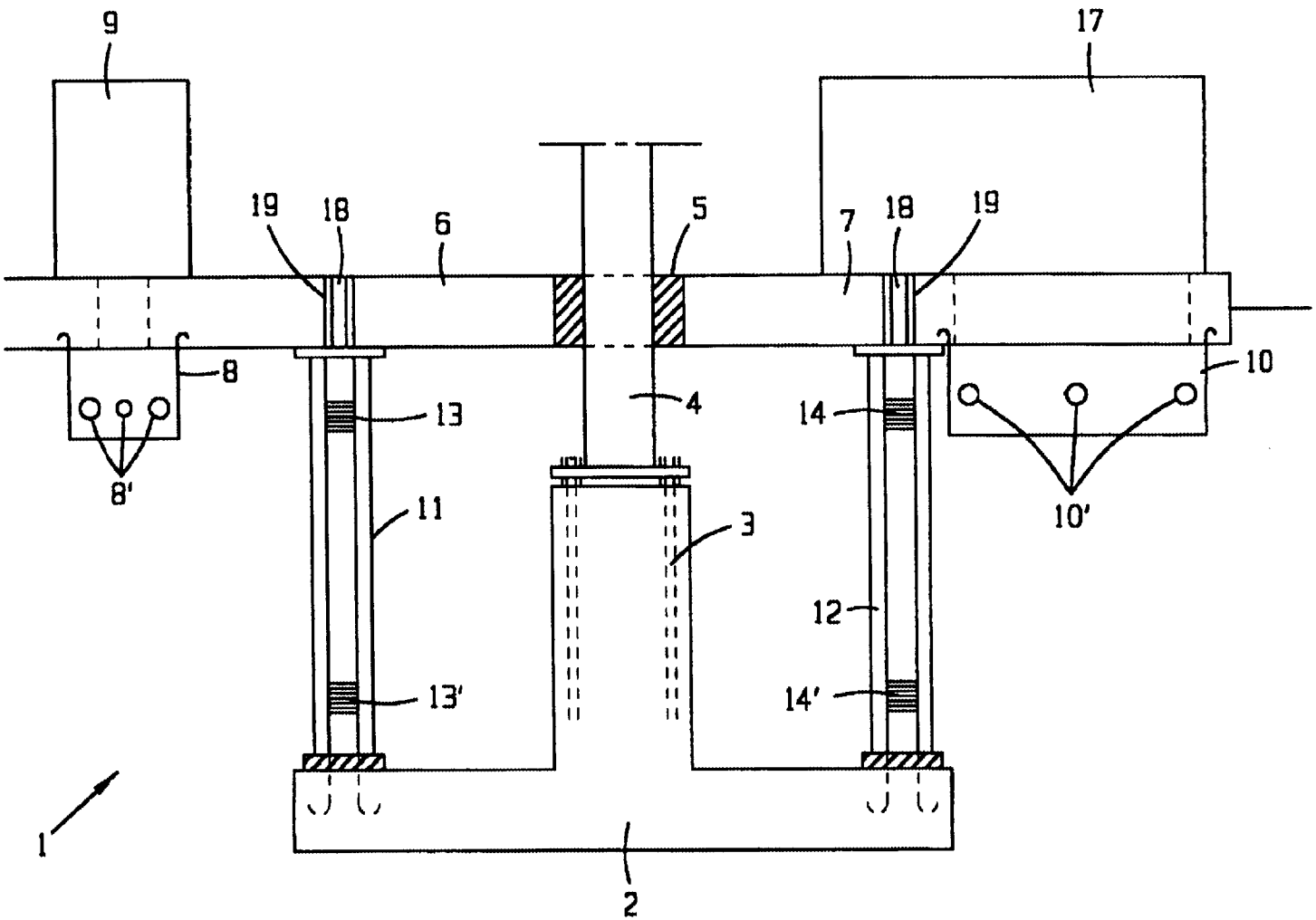
FIG. 1 shows a side-view of one of this invention's applications.
Figure 2:
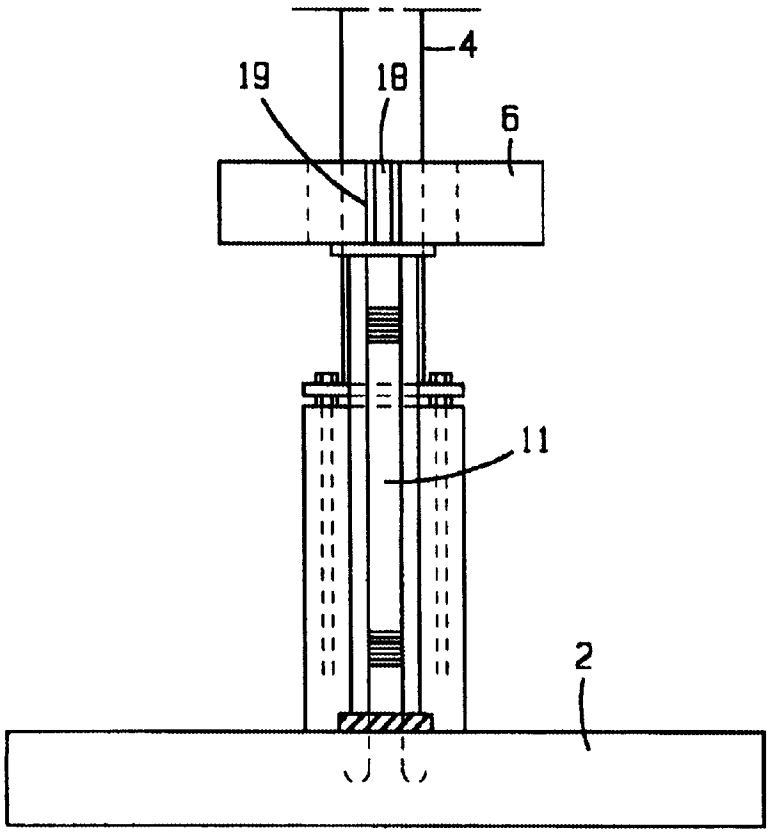
FIG. 2 shows the same structure as in FIG. 1 as seen when rotated through 90° and with its structure simplified.

FIG. 1 shows the structure and connection of two components of this invention in apparatus 1. The foundation is formed from the roofs footing elements 2. Two externally threaded sleeves 13' and 14' are fitted to the footing element 2, as shown in the illustration. After the installation of the footing element 2, the adjustable tubes 11, 12 are screwed into the sleeves to the required level. The adjustable tubes 11, 12 screw into the sleeves, because their external diameter is appropriate to fit the sleeve's thread. The adjustable tubes 11, 12 can be sheathed, if required, within appropriately sized rubber tubing.

If the additional adjustable pieces 13, 14 are required, which are of an appropriate external diameter to fit the adjustable tubes and are economically fitted with plates and which abut the islands 6, 7, these can be fitted to the upper ends of the adjustable tubes. The steel-plate's size is adjusted according to the shape and size of the installed islands. Also shown in FIG. 1 there is the adjusting rod 18 placed through a hale 19 in the island. This rod 18 can be used for after adjusting the island, when necessary, without the need for big scale operations. The adjusting car be simply made from above the island.

Next the islands 6, 7 can be placed into position. The island contains pumps 8 and 10 for the fitting of the distribution equipment, at an appropriate distance from the adjustable tubes 11 and 12. The islands 6, 7 is a particularly reinforced concrete.

The island is not fixed but freely installed on top of the previously described steel plates. The island contains the necessary hole 5 for the roof structure for the pillars subsequent installation. An alternative method is that the island can be assembled from two separate parts 6 and 7, in which case the load-bearing pillar 4 for the forecourt roof is first placed into position in the footing 2 for example by the conventional method of fixing with bolts 3 and by welding two horizontal plates onto either side of the steel pillar, between which the head of the island is inserted and, if necessary, fixed firmly into position.

If the hole method is used, the lightweight structure's elements only support their own weight and the weight of the equipment there is no intention of placing further weight, even at a later stage, onto the is. The distribution pump 17 and automatic dispenser 9 or other necessary infrastructure are also pre-fitted to the islands 6, 7.

After this, filling takes place right up to the level of the top of the roof's footing and the roof pillar 4 for the supply mechanism's familiar elements is erected if it has not already been erected as described previously.

After this, the forecourt building layers and sealing membrane 16, which can be fitted congruently beneath the pumps 6, 7, are constructed. The position of the membrane is illustrated in both FIGS. 4 and 6. The membrane 18 also goes conveniently underneath the installation wells 8, 10. The membrane 16 is also sealed at the location of the adjustable tube 11, 12, because a plastic tube is fitted over these. The membrane 16 is welded to the tube or sealed using, for example, installation sealant, as with the prior art.

Hardcore is laid for the forecourt drainage and absorbance and gas collection tubes for the distribution mechanism and other equipment are fed above the membrane 16. After this, the surface layers are laid. The traditional equipment and pipework etc. are excluded from the illustrations, apart from the tube 15, which is diagrammatically represented in FIG. 4 and which, as can be seen, is sealed and goes conveniently through the fitting hole shown in FIG. 3.

With the help of this modular system, the performance of mechanical fitting work independently of the construction work is nude possible. The completed island as a finished structure, at least partly bears on the ground.

It is clear that in constructions of the nature of that illustrated here, particular attention is given to the effects of frost for example, as the structures' foundations extend to a depth beyond that which is penetrated by frost.

The invention can be adapted in many ways. So although the brazing of the adjustable tube's 11, 12 resections 13', 14' to the concrete-footing is shown in the illustrations as an economical attachment option, other means of attachment, such as welding, bolting etc. can also be considered.

The installation wells 8, 10 which are shown in the illustrations, are specifically of solvent resistant plastic, from which generally quite light structures can be made. The fitting holes 8', 10' for the fuel-pipes, electrical and telecommunications and other necessary components, are ready fitted within the installation wells 8, 10. The sky of the installation wells is chosen according to requirements. Typically there are 1–4 installation pits per island. The illustration shows how the sumps 8, 10 are fixed to the concrete islands 6, 7.

When the protective membrane 16 has been fitted to the ground, all of the fuel-pipes and electric system pipes which are fitted to the installation wells 8, 10 of the islands 6, 7, remain above the membrane 16, which ensures that environmental damage is avoided, even if a pipe or other structure should begin to leak. Obviously the forecourt includes all of the monitoring equipment which are required by the law and regulations, against possible accidents. These are not, however, described or illustrated here.

The figure illustrates how the protective membrane 16 continues unbroken beneath the islands and sumps. The load-bearing pillar is covered with a protective membrane, which is joined to the forecourt protective membrane 16. Protective pipes are used around the installation pipes of the modular system such that ft is also joined to the protective membrane 16.

With the aid of this invention, considerable benefits are attained. With the aid of this invention, the distribution equipment and the forecourt can be constructed rapidly and the distribution equipment rapidly brought into use. This invention offers the possibility of combining and installing independently of each other the distribution equipment associated with fuel distribution and the station canopy's constructional engineering.

A forecourt which is sealed and well protected, in accordance with environmental regulations, is constructed with the aid of this modular system. The forecourt equipment is divided into separate forecourt structures with the aid of this modular construction, whereby forecourt subsidence is not able to damage pipework or installation wells, nor do they cause uneven subsidence of the islands.

The invention combines the pipework and electrical installations in the pump and automatic dispenser with the construction of the island and canopy foundation. The installations for the distribution equipment can be pre-fitted in this modular system. Only the fitting of the pump's intake pipes and petrol-vapor recovery pipes to the island take place in situ. The elements are fitted to each other without special supports or structures. Forecourt filling work can be performed immediately after the installation of the islands and other work can be performed on the island independently of the filling work.

In addition, the island made according to this invention can be set precisely at the desired height and adjustments to the height level during its working life are easily made. The final carrying capacity of the ground-based island is accomplished upon the completion of the filling work.

The installation of the island does not depend upon the depth of the roof's foundation but can be adjusted with the aid of the adjustment system of this invention.

With the aid of this invention, the canopy, its footing and the island, complete with its installation wells, can be easily and rapidly reusable and recyclable also in a subsequent location.

Subsequent alterations to be made to the station's forecourt are easy to accomplish, because the island, with the aid of its installation pipes, remains in is position in the air, even it the surrounding soil is excavated. By means of this artifice, considerable economical savings are achieved, because pumps; automatic dispensers and other equipment do not need to be dismantled from their footings.

What is claimed is:

1. A modular, adjustable motor vehicle fuel distribution forecourt system, comprising:

a. a concrete footing;

b. a plurality of island support columns connected to and extending vertically from the concrete footing, each island support column having an adjustment rod extending above it's top end;

c. a canopy support pillar connected to and extending vertically from the concrete footing, the canopy support pillar being adapted for support of a canopy above the forecourt system;

d. an island of a predetermined configuration supported on the island support columns, whereby adjustment of the island support column adjustment rod levels the island, and e. at least one installation well connected to and disposed below the island, the installation well having connectors for fuel, electrical or communication purposes, the installation well being constructed of a solvent resistant plastic; and f. a solvent resistant, protective membrane disposed below the island, the protective membrane being sealingly connected to the island support columns and the canopy support pillar.

2. A fuel distribution forecourt system, comprising a canopy pillar erected on a concrete footing, the canopy pillar being adapted to support a canopy an island adapted to support a fuel dispenser, the island being supported by at least one adjustable island support column erected on the concrete footing and a plastic surface disposed on the island support columns and a protective membrane sealingly connected to the plastic surface, the protective membrane being adapted to extend below the island to prevent environmental damage from a fuel leak thereon.

3. A system according to claim 2, further comprising pre-fitted fuel pumps, automatic dispensers and sumps disposed on the island.

4. A system according to claim 2, further comprising an adjusting rod extending from a top end of the island support column and coming through a hole in the island for adjusting the level of the island.

5. A method for making a system for fuel distribution, the system including at least one fuel dispenser, comprising forming a concrete footing to a desired depth, attaching a vertically adjustable, island support column to the concrete footing, installing an island on the island support column, the island being adapted to support the fuel dispenser, installing a canopy pillar on the concrete footing, the canopy pillar extending above the island, and installing a sealed protective membrane below the island, the protective membrane being sealed to the canopy pillar and to the island support column.

6. A method of making a modular, adjustable motor vehicle fuel distribution forecourt system, comprising:

a. forming a concrete footing;

b. connecting a plurality of adjustable length island support columns to the concrete footing, c. connecting a canopy support pillar to the concrete footing, the canopy support pillar being adapted for support of a canopy above the forecourt system;

d. placing an island of a predetermined configuration on the island support columns, e. adjusting the length of at least one island support column to level the island; and f. placing a solvent resistant, protective membrane below the island, the protective membrane being sealingly connected to the island support columns and the canopy support pillar.

7. A fuel distribution forecourt system, comprising a canopy pillar erected on a concrete footing, the canopy pillar being adapted to support a canopy an island adapted to support a fuel dispenser, the island being supported by at least one adjustable island support column erected on the concrete foot pre-fitted fuel pumps, automatic dispensers and sumps disposed on the island.

8. A fuel distribution forecourt system, comprising a canopy pillar erected on a concrete footing, the canopy pillar being adapted to support a canopy, an island adapted to support a fuel dispenser, the island being supported by at least one adjustable island support column erected on the concrete footing, and an adjusting rod extending from a top end of the island support column and coming through a hole in the island for adjusting the level of the island.

* * * * *